US009441642B2

(12) United States Patent
Rao et al.

(10) Patent No.: US 9,441,642 B2
(45) Date of Patent: Sep. 13, 2016

(54) STRUCTURE FOR REDUCING NOISE OF VENTILATING FAN

(75) Inventors: Zewei Rao, Foshan (CN); Zhenjian Yang, Foshan (CN); Xiaoming Li, Foshan (CN)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 1032 days.

(21) Appl. No.: 13/634,022

(22) PCT Filed: Jul. 9, 2010

(86) PCT No.: PCT/CN2010/001028

§ 371 (c)(1),
(2), (4) Date: Oct. 11, 2012

(87) PCT Pub. No.: WO2011/113184

PCT Pub. Date: Sep. 22, 2011

(65) Prior Publication Data

US 2015/0337862 A1 Nov. 26, 2015

(30) Foreign Application Priority Data

Mar. 17, 2010 (CN) ..... 2010 1 0130212

(51) Int. Cl.
*F04D 29/44* (2006.01)
*F04D 29/66* (2006.01)
(Continued)

(52) U.S. Cl.
CPC ..... *F04D 29/665* (2013.01); *F04D 29/162* (2013.01); *F04D 29/4226* (2013.01); *F04D 29/441* (2013.01); *F04D 29/663* (2013.01)

(58) Field of Classification Search
CPC . F04D 29/665; F04D 29/4226; F04D 29/441
USPC ..... 415/119
See application file for complete search history.

(56) References Cited

U.S. PATENT DOCUMENTS 2,160,666 A * 5/1939 McMahan ..... F04D 29/281 181/207
5,352,089 A * 10/1994 Tokunaga ..... B60H 1/00471 415/119

(Continued)

FOREIGN PATENT DOCUMENTS

CN 1073241 6/1993
CN 1784547 6/2006

(Continued)

OTHER PUBLICATIONS

International Search Report for International Application No. PCT/CN2010/001028 dated Dec. 30, 2010.

(Continued)

*Primary Examiner* — Igor Kershteyn
*Assistant Examiner* — Aaron R Eastman
(74) *Attorney, Agent, or Firm* — RatnerPrestia

(57) ABSTRACT

Disclosed is a structure for reducing noise of a ventilating fan. The structure includes an orifice plate fixed on a scroll casing and is shaped to be an annular and semi-surrounding hollow structure in order to match with the shape of an air inlet of the scroll casing, and to cover only the air inlet of the scroll casing. The noise generated by an air blower of the ventilating fan can be directed along a bell mouth of the scroll casing of the ventilating fan after being emitted from the air inlet of the scroll casing, and then can be smoothly sucked by the orifice plate. The sucked-in noise can repeatedly collide with the orifice plate and be diffused, thereby the energy being gradually weakened and the sound pressure thereof being decreased.

6 Claims, 8 Drawing Sheets

(51) Int. Cl.
*F04D 29/42* (2006.01)
*F04D 29/16* (2006.01)

(56) References Cited

U.S. PATENT DOCUMENTS 5,525,036 A 6/1996 Park
6,092,988 A 7/2000 Botros
7,207,774 B2 * 4/2007 Kashiwazaki ..... F04D 29/4226 415/203
7,476,076 B2 * 1/2009 Shimada ..... F04D 29/162 415/119
7,517,185 B2 * 4/2009 Hirakawa ..... F04D 17/04 415/119
2002/0154993 A1 * 10/2002 Kamiya ..... B60H 1/00471 415/204
2005/0260071 A1 11/2005 Hsu et al.
2006/0198729 A1 * 9/2006 Yamasaki ..... F04D 29/162 415/206
2007/0041831 A1 2/2007 Bartlett
2007/0125525 A1 * 6/2007 Heine ..... F28F 9/002 165/121
2007/0270283 A1 * 11/2007 Liu ..... A63B 49/00 482/8
2010/0189547 A1 * 7/2010 Shirahama ..... F04D 29/664 415/119

FOREIGN PATENT DOCUMENTS

DE 10003396 8/2001
WO WO 2009/130891 10/2009

OTHER PUBLICATIONS

Written Opinion for International Application No. PCT/CN2010/001028 dated Dec. 30, 2010.

* cited by examiner

10

120

STRUCTURE FOR REDUCING NOISE OF VENTILATING FAN

CROSS-REFERENCE TO RELATED APPLICATIONS

This application claims the benefit of Chinese patent application No. 201010130212.3, which was filed on Mar. 17, 2010, and which is incorporated herein in its entirety by reference.

BACKGROUND OF THE INVENTION

1. Field of the Invention

The present invention relates to a structure for reducing noise, and more particular, to a structure for reducing noise of a ventilating fan.

2. Description of the Related Art

FIG. 1 shows a known type of a ventilating fan 10. Typically, a plate 12 having orifices (hereinafter orifice plate 12) which are located below a scroll casing 11 of the ventilating fan is employed to reduce noise of the ventilating fan 10. The orifice plate 12 has the same size as that of an opening 14 of a housing 13 of the ventilating fan, and is configured to cover the opening 14. The orifice plate 12 is fixed with the scroll casing 11 by screws.

The noise-reduction structure of the ventilating fan in the prior art is problematic in the following aspects: 1) since an area of the orifice plate 12 is large and thus a space formed by it with the scroll casing 11 is also large, the suctioned air will generate turbulence in the space, thereby creating noise; 2) since the area of the orifice plate is so large, it necessitates more materials to manufacture it, therefore thus its cost is very high; and 3) because the orifice plate 12 has such a large area, a plurality of screws are needed to fix it, and this results in more mounting time and low efficiency in operation.

Typically, as shown in FIG. 2, when the ventilating fan incorporating the noise-reduction structure in the prior art operates in a frequency zone of 500 Hz-1000 Hz, the noise generated is in the range from 14 to 23 dB.

SUMMARY OF THE INVENTION

The present invention has been made to overcome or alleviate at least one aspect of the above mentioned disadvantages.

An object of the present invention is to provide a structure for reducing noise of a ventilating fan which can reduce the noise of the ventilating fan more effectively and efficiently.

Another object of the present invention is to provide a structure for reducing noise of a ventilating fan, which has a simplified structure and can be easily assembled and removed.

According to an aspect of the present invention, there is provided a structure for reducing noise of a ventilating fan, comprising an orifice plate fixed on a scroll casing and is shaped to be an annular and semi-surrounding hollow structure in order to match with a shape of a air inlet of the scroll casing, wherein the orifice plate covers only the air inlet of the scroll casing.

The orifice plate is configured to be a hollow structure having a cross section of J shape, the orifice plate being formed with a lower side and a higher side, and a spacing is arranged between a forward end of the lower side and the air inlet.

A plurality of protruding ribs are disposed inside of the hollow structure of the orifice plate.

A plurality of convex and concave structures are disposed inside of the hollow structure of the orifice plate.

A first convex part and a second convex part are disposed outside of the orifice plate, a hole is arranged in the second convex part; and a snap joint for snapping the first convex part and an mounting hole corresponding to the hole of the second convex part are arranged in the scroll casing.

An outer diameter of the orifice plate equals to an outer diameter of the air inlet of the scroll casing.

According to a nonspecific embodiment of the present invention, the structure for reducing noise of a ventilating fan is advantageous to effectively reduce noise, to have a simplified structure and to be easily assembled and removed.

DETAILED DESCRIPTION OF THE PREFERRED EMBODIMENT

Figure 1:
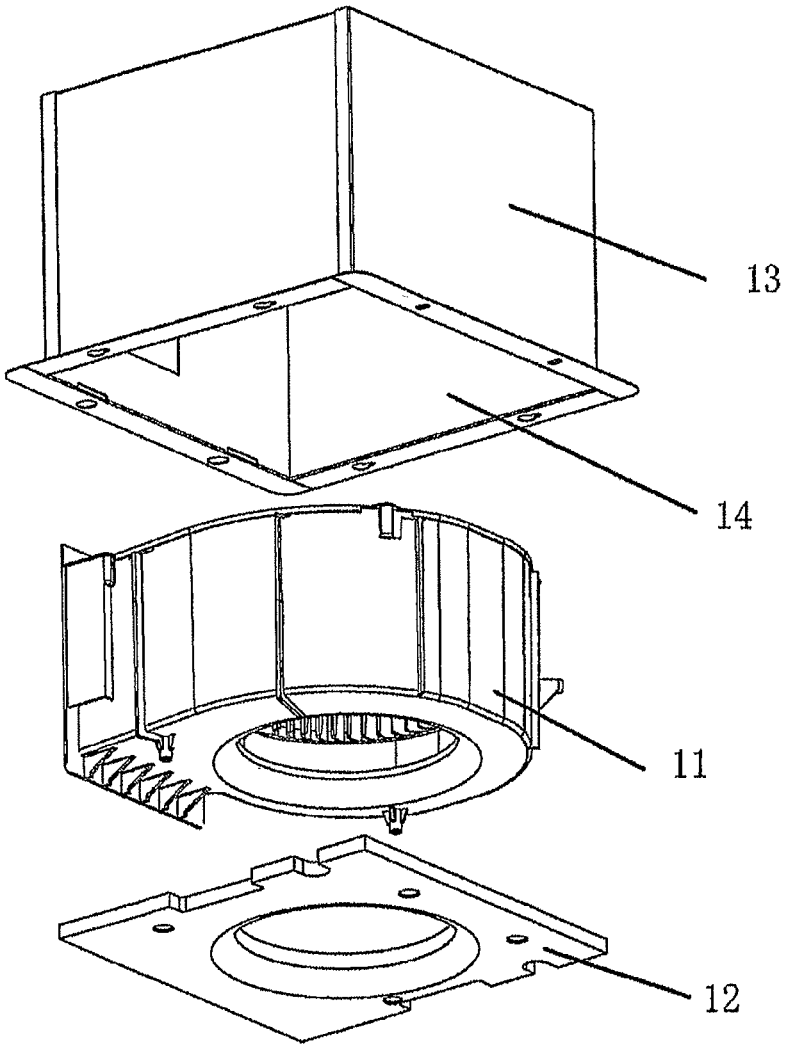
Prior Art Fig. 1
FIG. 1 is a schematic view of a noise-reduction structure in the prior art.
Figure 2:
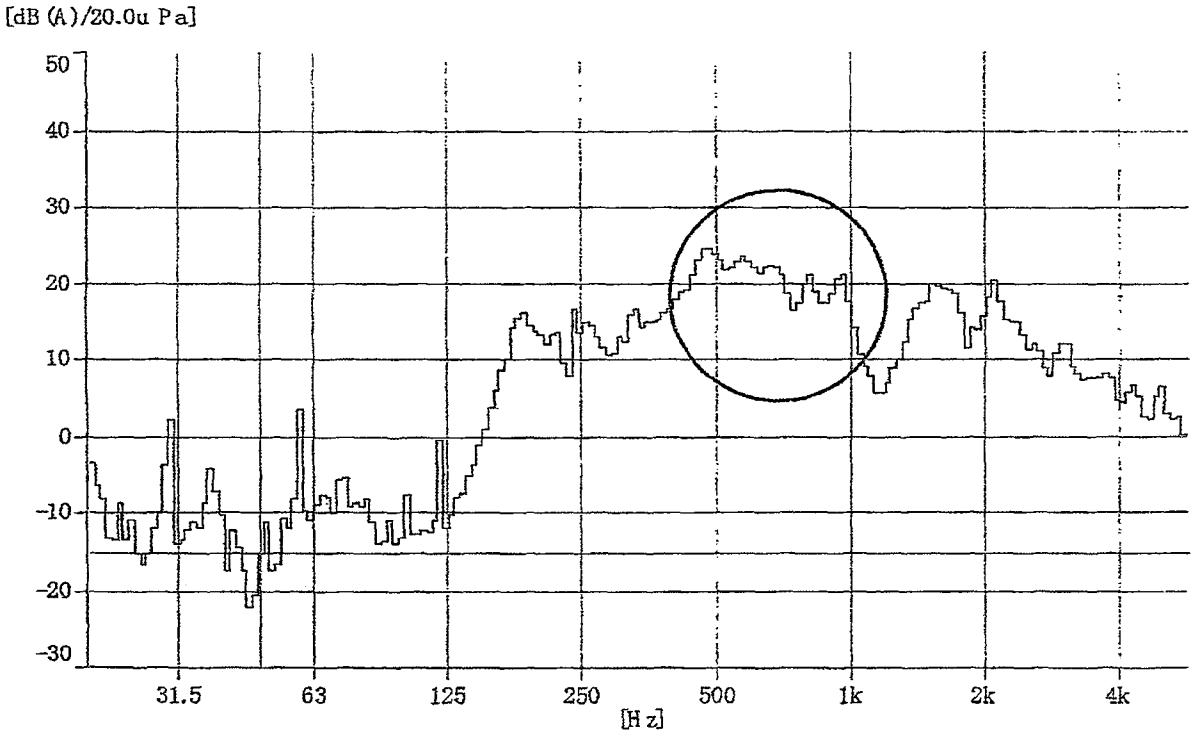
Prior Art Fig. 2
FIG. 2 shows noise test result of the noise-reduction structure in the prior art.
Figure 3:
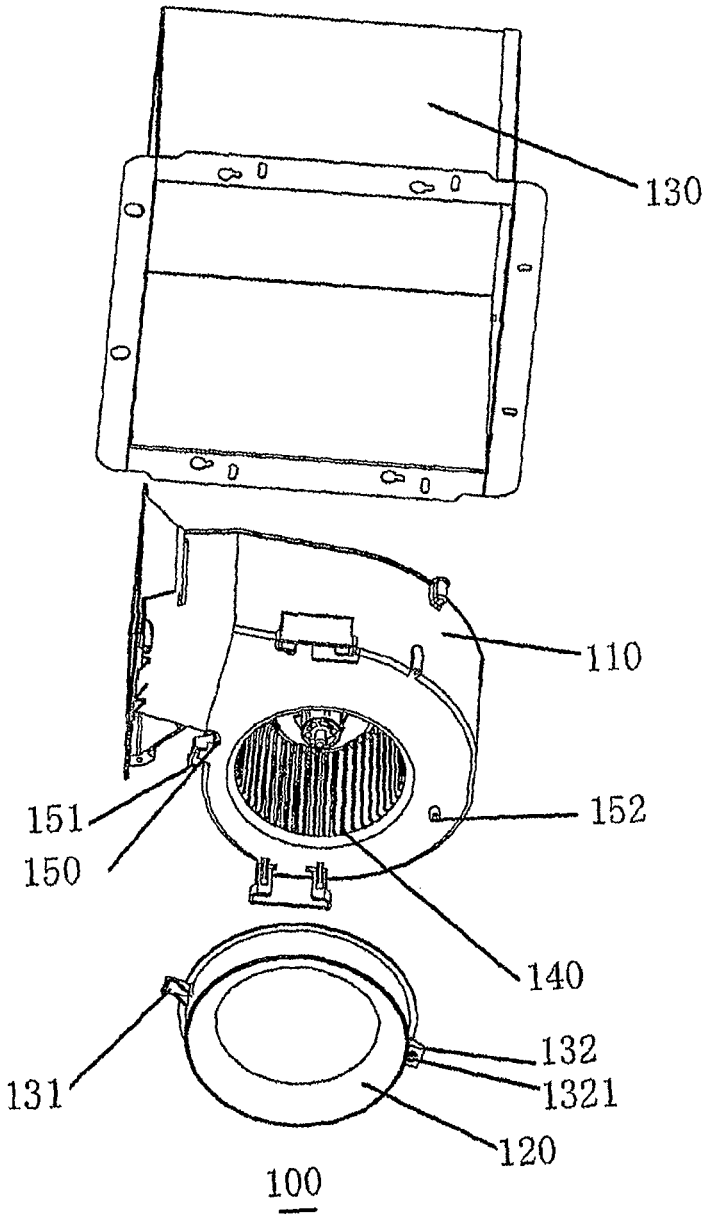
FIG. 3 is a schematically overall view of a noise-reduction structure in the present invention.

FIG. 3 shows a schematic overall view of a noise-reduction structure of the present invention. The ventilating fan 100 includes a housing 130, into which a scroll casing 110 with an air blower is installed. An orifice plate 120 is fixed onto the scroll casing 110, and forms as a semi-surrounding and hollow annular structure in order to match with the shape of a air inlet 140 of the scroll casing 110. The orifice plate 120 covers only the air inlet 140 of the scroll structure 110, which is meant not to cover the overall housing as in the prior art.

Figure 4:
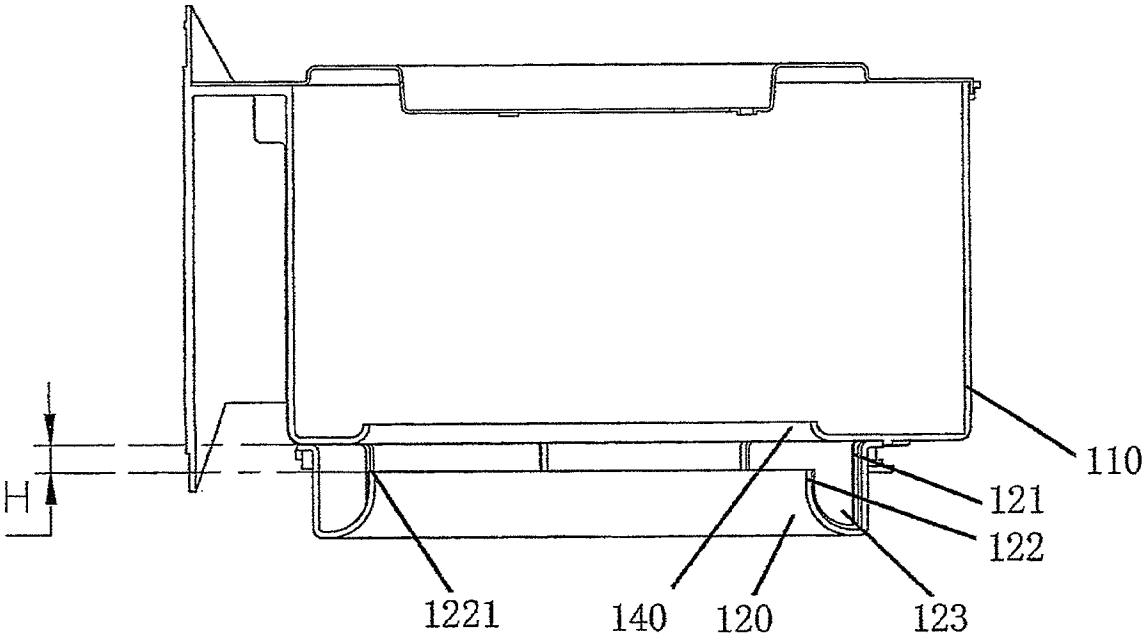
FIG. 4 is a schematic view of an orifice plate in the present invention.

FIG. 4 shows a schematic view of the orifice plate of the present invention. The orifice plate 120 is formed to be a semi-surrounding structure in order to match with the shape of the air inlet 140 of the scroll casing 110. The term "semi-surrounding structure" means that one side of a section of the orifice plate 120 is high and the other side thereof is low (i.e., having a higher side 121 and a lower side 122), and the middle part between the higher side 121 and the lower side 122 is a hollow structure 123, thereby the overall section of the orifice plate 120 is configured to have a substantially J-shape. The lower side 122 of the orifice plate 120 section faces to the air inlet 140 side of the scroll casing, while the higher side 121 faces to the housing 130 side (not shown) of the ventilating fan. In other words, the higher side 121 is disposed to extend linearly from a surface in which the air inlet 140 of the scroll casing 110 is located, and the lower side 122 is arranged toward the air inlet 140 from the higher side 121 (that is, the higher side 121 meanderingly extends and locates toward the surface arranged with the air inlet 140), thereby forming the lower side 122. There is a spacing H between a forward end 1221 of the lower side 122 and the air inlet 140. In other words, the higher side 121 of the J-shape has a cylinder shape which extends along a vertical direction from the scroll casing 110, while the lower side 122 is a curved shape which is formed by arcing toward the air inlet 140 from the higher side 121 and then stretching along a horizontal direction. In addition, the section has appropriately a 3 shape formed by combining a straight line in a longitudinal direction and a curved line being stretched toward the horizontal direction. Moreover, a portion located at the spacing H (hereinafter spacing H portion) is in communication with the hollow structure by a forward portion right in front of the air inlet 140.

Figure 5:
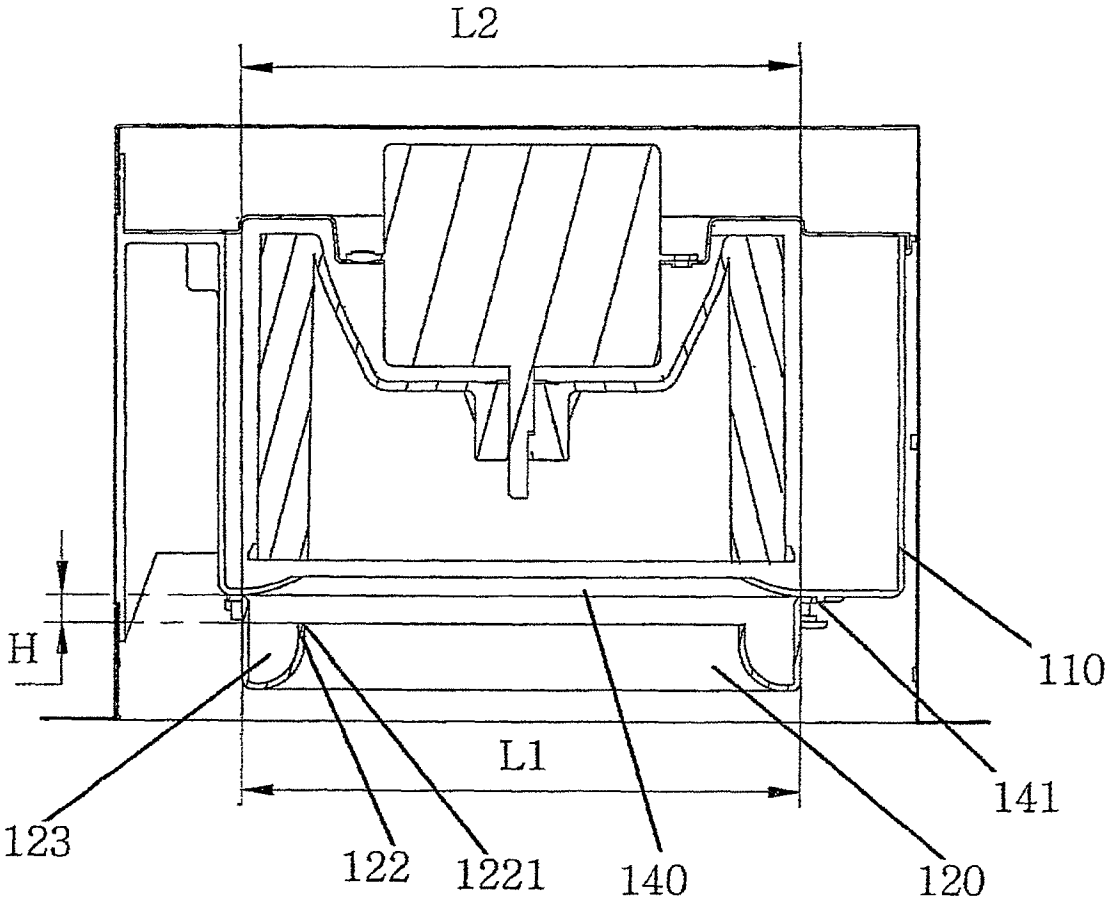
FIG. 5 is a schematic view illustrating a relationship between diameters of the orifice plate and the scroll casing in accordance with the present invention.

FIG. 5 shows a schematic view illustrating the relationship between the diameters of the orifice plate and the scroll casing in accordance with the present invention. An outer diameter L1 of the orifice plate 120 equals to an outer diameter L2 of the air inlet 140 of the ventilating fan. The outer diameter L2 of the air inlet 140 of the scroll casing 110 as described above is referred to the diameter L2 of the farthest end of a skirt portion of a bell mouth in the scroll casing 110. In other words, a bell-mouthed panel 141 is located at the air inlet 140 of the scroll casing 110, and the outside diameter L2 of the panel 141 (the diameter of the portions where the panel 141 starts) and the outer diameter of the orifice plate 120 (i.e., an outer diameter of the higher sides 121) are equally arranged.

When the air blower operates, the noise generated by the air blower mainly emits from the air inlet 140 of the scroll casing 110. The noise generated at the air inlet 140 of the scroll casing 110 can be directed along the bell mouth of the scroll casing in the ventilating fan by disposing the orifice plate 120 at the noise source position of the air inlet 140 of the scroll casing 110, and be smoothly sucked by the orifice plate 120. That is, the noise enters into the hollow structure 123 of the plate from the lower side 122 through the portion between the forward end 1221 of the orifice plate 120 and the air inlet 140 (the spacing H portion), and thus the sucked-in noise will repeatedly impinge onto the hollow structure 123 and be diffused. During such process, the energy of the noise will gradually be weakened and the sound pressure thereof will be reduced.

Figure 6A:
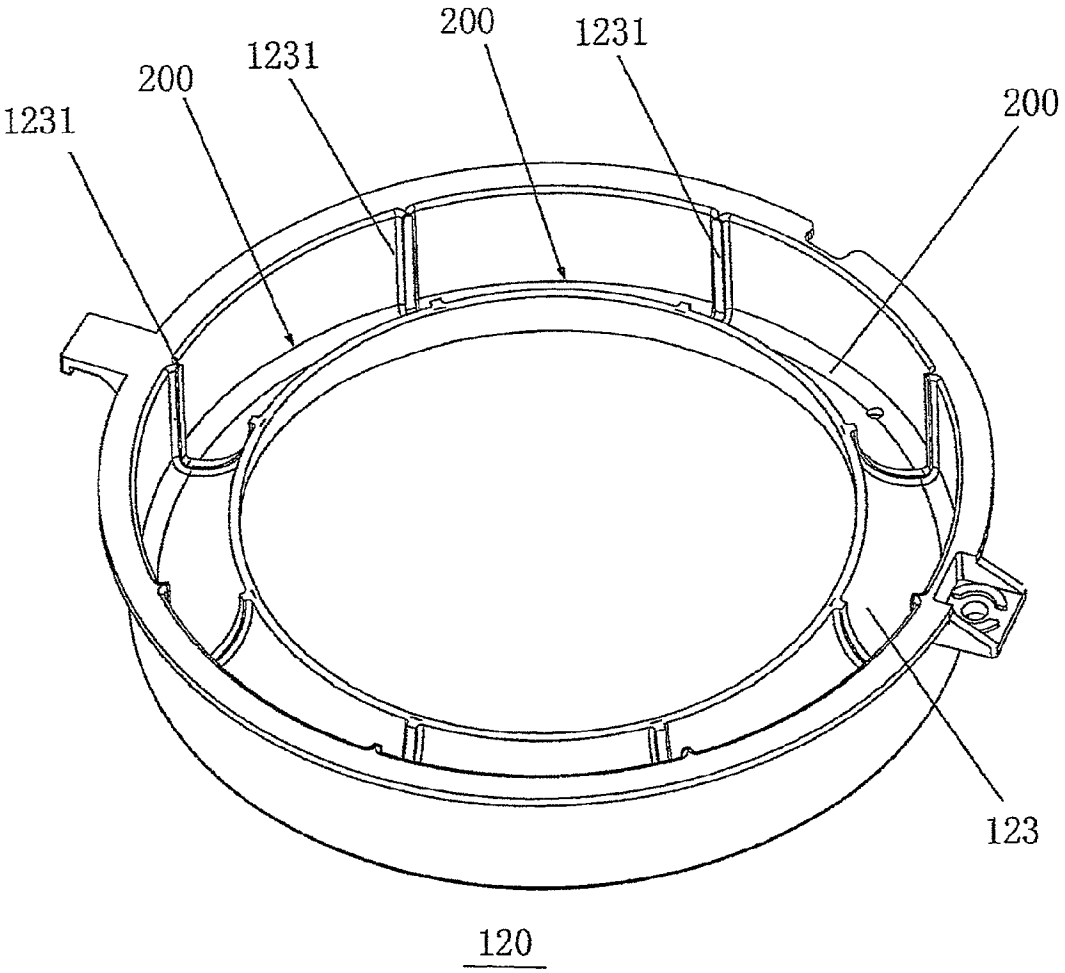
FIG. 6A is a schematic view of the orifice plate in accordance with a first embodiment of the present invention.

FIG. 6A shows a schematic view of the orifice plate in accordance with the first embodiment of the present invention. In order to further weaken noise, a plurality of protruding ribs 1231 are located inside of the hollow structure 123 of the orifice plate 120 in the present invention. The protruding ribs 1231 arranged herein will split the orifice plate having the annular and semi-surrounding hollow structure 123 into a plurality of small spaces 200. The noise generated at the air inlet 140 of the ventilating fan (not shown) is sucked into the annular and semi-surrounding hollow structure 123 and then the sucked-in noise will repeatedly impinge onto the orifice plate within the small spaces 200 and be diffused. During such process, the energy of the noise will gradually be weakened and the sound pressure thereof will be reduced. Strength of the orifice plate will also be enhanced by providing the protruding ribs 1231.

In other words, the protruding ribs 1231 can reduce vibrations of the orifice plate 120 induced by the air flowing toward the air inlet 140 of the scroll casing 110. The effect of reducing the noise will become better by the hollow structure 123.

Figure 6B:
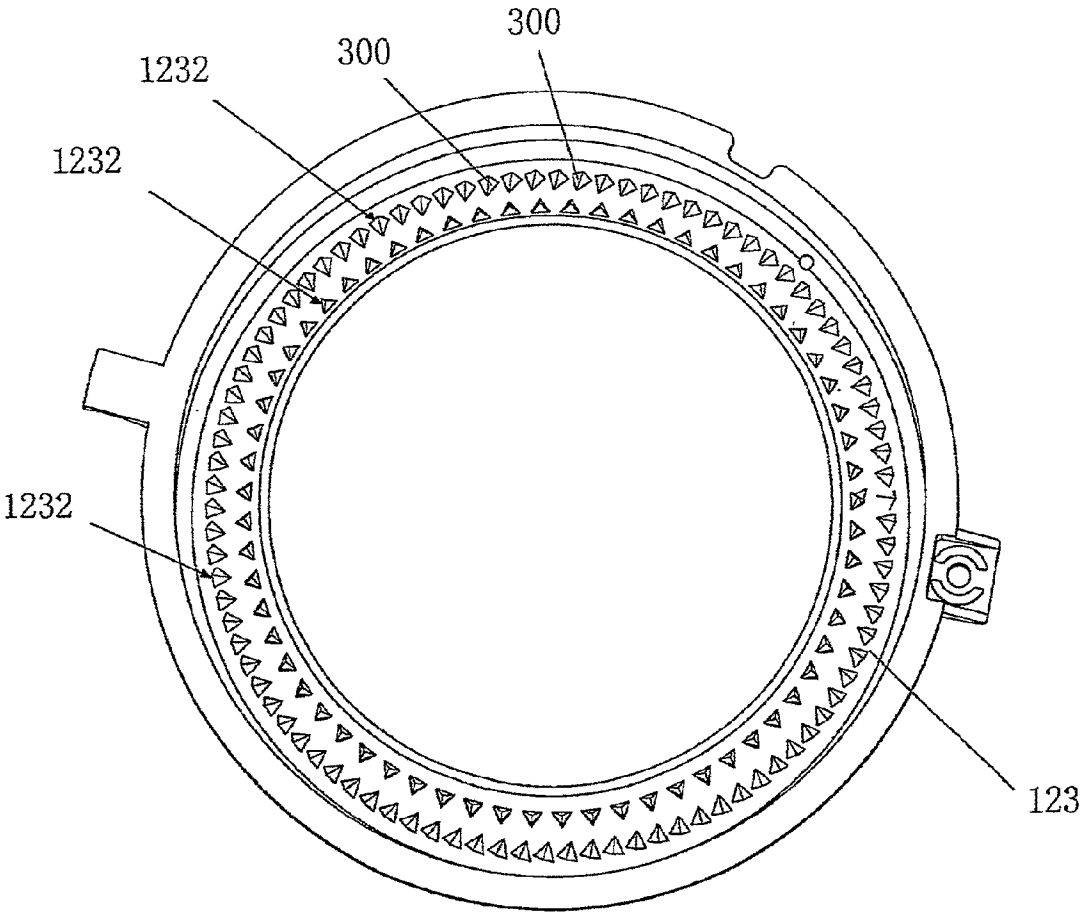
FIG. 6B is a schematic view of the orifice plate in accordance with a second embodiment of the present invention.

FIG. 6B shows a schematic view of the orifice plate in accordance with the second embodiment of the present invention. In order to further weaken the noise, a plurality of convex and concave structures 1232 are disposed inside of the hollow structure 123 of the orifice plate 120 in the present invention. Such convex and concave structures 1232 will split a surface in the annular and semi-surrounding hollow structure 123 into a plurality of interlaced and distributed facets 300. The noise generated at the air inlet 140 of the ventilating fan (not shown) is sucked into the annular and semi-surrounding hollow structure 123 and then the sucked-in noise will repeatedly be reflected onto the facets 300 within the hollow structure. During such process, the energy of the noise sound waver will gradually be weakened and the noise will be reduced.

Figure 7:
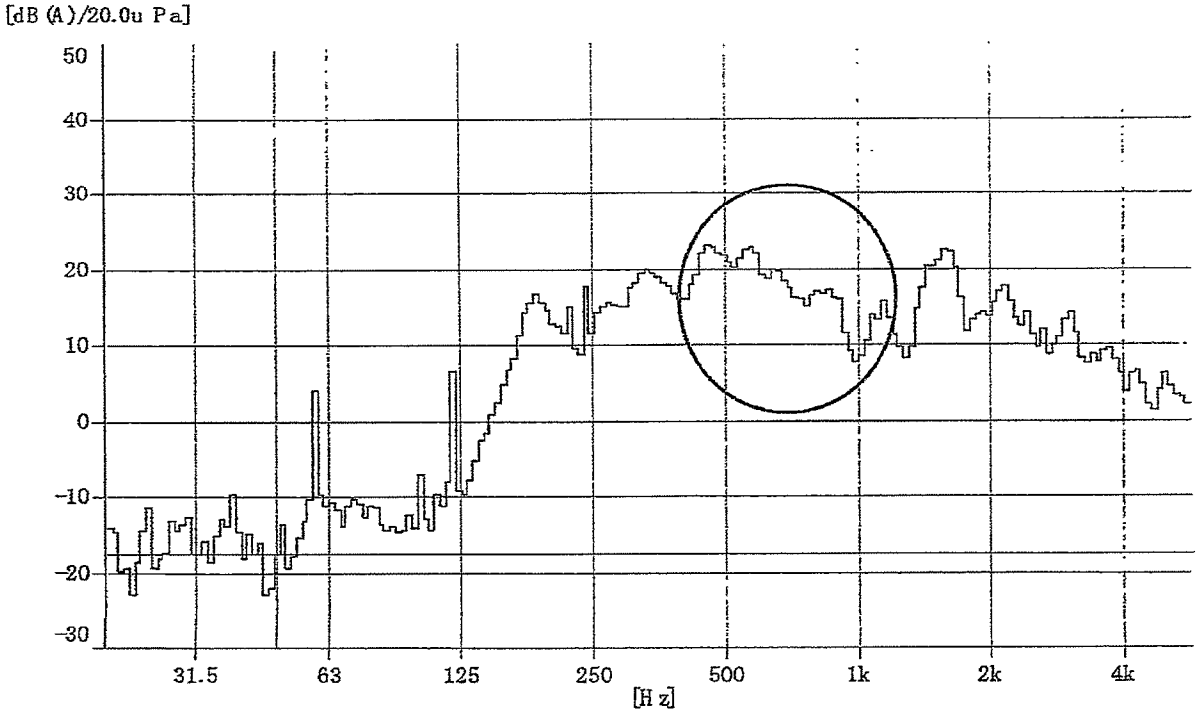
FIG. 7 shows noise test result of the present invention.

As shown by FIG. 7, when the ventilating fan operates at the frequency zone of 500 Hz~1 KHz, the noise value will be in the range of 8~21 dB. As compared with the prior art, the noise value will be reduced by 2 dB on average.

Referring back again to FIG. 3, in order to facilitate installation, a first convex part 131 and a second convex part 132 are disposed outside of the orifice plate 120, and the second convex part 132 is arranged with a hole 1321. A snap joint 151 for snapping the first convex part 131 and an mounting hole 152 corresponding to the hole 1321 on the second convex part 132 are located on the scroll casing 110. With the above configuration, the first convex part 131 is firstly inserted into the snap joint 151 on the scroll casing and then the screw is passed through the hole 1321 of the second convex part 132 and the mounting hole 152 of the scroll casing 110, thereby finally fixing the orifice plate 120 onto the scroll casing 110. Therefore, the structure of the ventilating fan is simplified and the product constructability thereof is improved.

In addition, the scroll casing is formed or moulded from synthetic resin. The snap joint 151 as shown by FIG. 3 is located at a periphery of the scroll casing 110, and it is easier to be formed or moulded since it is arranged adjacent to a tongue portion 150. In other words, the snap joint 151 can be formed by de-molding along the thickness direction of the scroll casing 110.

Furthermore, since the tongue portion 150 is located at a portion which has a smallest R value in the outer periphery wall surface for forming the scroll casing 110, this portion is not easy to be deformed. Therefore, the snap joint 151 can be stably installed on the scroll casing 110.

In addition, the tongue portion 150 is located at a position closest to the center of the air net 140, the first convex part 131 can be disposed to be shorter. In other words, the first convex part 131 formed to be shorter does not deform easily.

Moreover, the orifice plate 120 can be tightly installed on the scroll casing 110 by snapping the first convex part 131 with the snap joint 151. Therefore, the silencing effect will become more reliable.

What is claimed is:

1. A structure for reducing noise of a ventilating fan, comprising:

a bell-mouthed panel located at an air inlet of a scroll casing; and an orifice plate fixed on the scroll casing;

wherein the orifice plate is shaped to be an annular and semi-surrounding hollow structure in order to match with a shape of the bell-mouthed panel, and covers only a front side of the air inlet of the scroll casing, the orifice plate comprises a radially outward side with respect to a longitudinal axis of the air inlet, a radially inward side, and a middle part in the form of a hollow structure that is disposed between the radially outward side and the radially inward side, wherein the radially outward side extends linearly from a surface in which the air inlet of the scroll casing is located, and the radially inward side extends from the radially outward side toward the air inlet, the radially outward side has a cylindrical shape which extends from the scroll casing in an axial direction parallel to the longitudinal axis of the air inlet, and faces a housing side of the ventilating fan, and the radially inward side has a curved shape and includes a fixed end extending from the radially outward side and a free end which arcs inwardly toward the longitudinal axis of the air inlet, the free end terminating at a location radially outside of the air inlet of the scroll casing.

2. The structure for reducing noise of the ventilating fan according to claim 1, wherein:

the orifice plate has a cross section of a J-shaped hollow structure formed with the radially inward side and the radially outward side, and a spacing portion is arranged between the free end of the radially inward side and the air inlet.

3. The structure for reducing noise of the ventilating fan according to claim 2, wherein:

a plurality of protruding ribs are disposed inside of the hollow structure of the orifice plate.

4. The structure for reducing noise of the ventilating fan according to claim 2, wherein:

a plurality of convex and concave structures are disposed inside of the hollow structure of the orifice plate.

5. The structure for reducing noise of the ventilating fan according to claim 2, wherein:

a first convex part and a second convex part are disposed outside of the orifice plate, a hole is arranged in the second convex part; and a snap joint for snapping the first convex part and a mounting hole corresponding to the hole of the second convex part are arranged in the scroll casing.

6. The structure for reducing noise of the ventilating fan according to claim 2, wherein:

an outer diameter of the orifice plate is equal to an outer diameter of the air inlet of the scroll casing.

* * * * *